US010746453B2

(12) United States Patent
Tarr et al.

(10) Patent No.: US 10,746,453 B2
(45) Date of Patent: Aug. 18, 2020

(54) ACTIVE ICE PRESS ASSEMBLY

(71) Applicant: Haier US Appliance Solutions, Inc., Wilmington, DE (US)

(72) Inventors: Ronald Scott Tarr, Louisville, KY (US); Justin Tyler Brown, Louisville, KY (US); Tomas Garces, Louisville, KY (US); Samuel Vincent DuPlessis, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 134 days.

(21) Appl. No.: 15/903,119

(22) Filed: Feb. 23, 2018

(65) Prior Publication Data

US 2019/0264970 A1 Aug. 29, 2019

(51) Int. Cl.
*F25C 5/08* (2006.01)
*F25C 5/14* (2006.01)

(52) U.S. Cl.
CPC . *F25C 5/08* (2013.01); *F25C 5/14* (2013.01)

(58) Field of Classification Search
CPC ..... F25C 5/08; F25C 5/14
See application file for complete search history.

(56) References Cited

U.S. PATENT DOCUMENTS

| | | | | |
|---|---|---|---|---|
| 4,833,894 | A * | 5/1989 | Chesnut | F25C 1/04 219/421 |
| 6,857,277 | B2 | 2/2005 | Somura | |
| 6,935,124 | B2 | 8/2005 | Takahashi et al. | |
| 9,151,527 | B2 | 10/2015 | Boarman et al. | |
| 9,459,034 | B2 | 10/2016 | Boarman et al. | |
| 9,574,811 | B2 | 2/2017 | Papalia | |
| 2004/0206250 | A1* | 10/2004 | Kondou | F25C 5/14 99/426 |

* cited by examiner

*Primary Examiner* — Joseph S Del Sole
*Assistant Examiner* — John Robitaille
(74) *Attorney, Agent, or Firm* — Dority & Manning, P.A.

(57) ABSTRACT

An active ice press is provided herein and may be utilized to reshape an initial ice billet as a sculpted ice nugget. The active ice press may include a mold body and an electric heater. The mold body may define an axial direction and a mold cavity within which the sculpted ice nugget is shaped. The mold body may include a first mold segment and a second mold segment. The first mold segment may define a first cavity portion of the mold cavity. The second mold segment may be movably positioned above the first mold segment along the axial direction. The second mold segment may define a second cavity portion of the mold cavity. The electric heater may be disposed within the mold body in conductive thermal engagement with the mold cavity.

18 Claims, 7 Drawing Sheets

ACTIVE ICE PRESS ASSEMBLY

FIELD OF THE INVENTION

The present subject matter relates generally to appliances for shaping ice and more particularly to an active appliance for shaping ice to a predetermined desired profile.

BACKGROUND OF THE INVENTION

In domestic and commercial applications, ice is often formed as solid cubes, such as crescent cubes or generally rectangular blocks. The shape of such cubes is often dictated by the environment during a freezing process. For instance, an ice maker can receive liquid water, and such liquid water can freeze within the ice maker to form ice cubes. In particular, certain ice makers include a freezing mold that defines a plurality of cavities. The plurality of cavities can be filled with liquid water, and such liquid water can freeze within the plurality of cavities to form solid ice cubes. Typical solid cubes or blocks may be relatively small in order to accommodate a large number of uses, such as temporary cold storage and rapid cooling of liquids in a wide range of sizes.

Although the typical solid cubes or blocks may be useful in a variety of circumstances, there are certain conditions in which distinct or unique ice shapes may be desirable. As an example, it has been found that relatively large ice cubes or spheres (e.g., larger than two inches in diameter) will melt slower than typical ice sizes/shapes. Slow melting of ice may be especially desirable in certain liquors or cocktails. Moreover, such cubes or spheres may provide a unique or upscale impression for the user.

In the past, users desiring larger or uniquely-shaped pieces of ice were forced to utilize cumbersome techniques and devices. As an example, large billets of ice may be shaved or sculpted by hand. However, sculpting ice by hand can be extremely difficult, dangerous, and time-consuming. In recent years, passive ice presses have come to market. Typically, these passive presses include large solid metal pieces that define a profile to which a larger ice billet may be reshaped. Generally, the passive presses rely on the large mass of the press to slowly melt a large ice billet into a desired shape. Such systems reduce some of the dangers and user skill required when reshaping ice by hand. However, the systems require large amounts of solid metal, and the process is still very time-consuming. Moreover, melting multiple pieces of ice in succession may require a user to place the passive press under hot water between each ice piece. Even still, the effectiveness of the passive press may be reduced in certain conditions, such that the desired shape is not always achieved.

Accordingly, further improvements in the field of ice-shaping would be desirable. In particular, it may be desirable to provide an appliance or assembly for rapidly and reliably producing ice pieces that have a relatively-large predetermined shape or profile.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an active ice press is provided to reshape an initial ice billet as a sculpted ice nugget. The active ice press may include a mold body and an electric heater. The mold body may define an axial direction and a mold cavity within which the sculpted ice nugget is shaped. The mold body may include a first mold segment and a second mold segment. The first mold segment may define a first cavity portion of the mold cavity. The second mold segment may be movably positioned above the first mold segment along the axial direction. The second mold segment may define a second cavity portion of the mold cavity. The electric heater may be disposed within the mold body in conductive thermal engagement with the mold cavity.

In another exemplary aspect of the present disclosure, an active ice press is provided to reshape an initial ice billet as a sculpted ice nugget. The active ice press may include a mold body, a base heater, and a top heater. The mold body may define an axial direction and a mold cavity within which the sculpted ice nugget is shaped. The mold body may include a first mold segment and a second mold segment. The first mold segment may at least partially define the mold cavity. The second mold segment may be movably positioned above the first mold segment between a receiving position spaced apart from the first mold segment along the axial direction and a sculpted position supported on the first mold segment. The second mold segment may at least partially define the mold cavity in the sculpted position. The base heater may be mounted within the first mold segment in conductive thermal engagement with the mold cavity. The top heater may be mounted within the second mold segment in conductive thermal engagement with the mold cavity.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
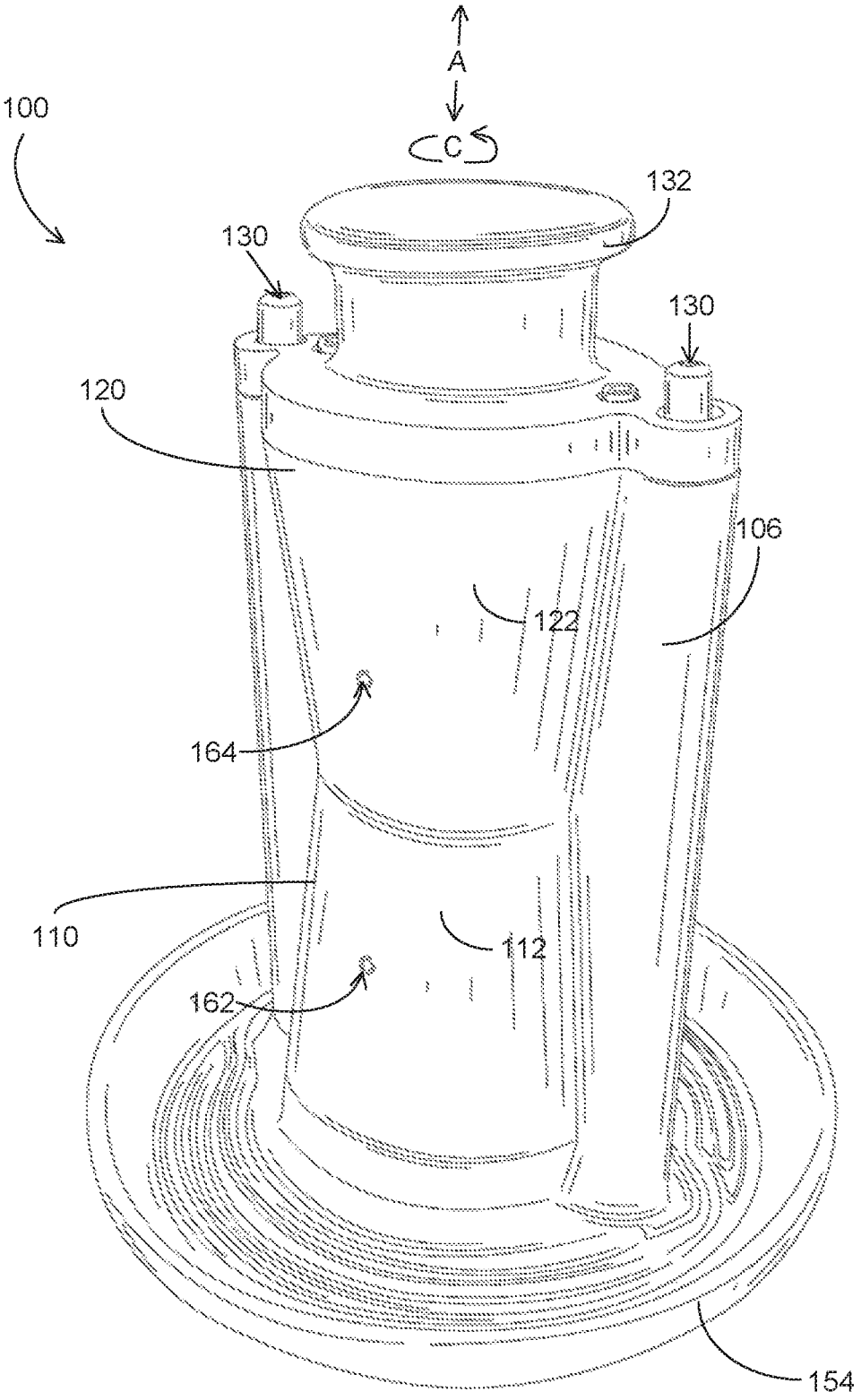
FIG. 1 provides a perspective view of an ice press appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first," "second," and "third" may be used interchangeably to distinguish one component from another and are not intended to signify location or importance of the individual components. The term "or" is generally intended to be inclusive (i.e., "A or B" is intended to mean "A or B or both").

Figure 2:
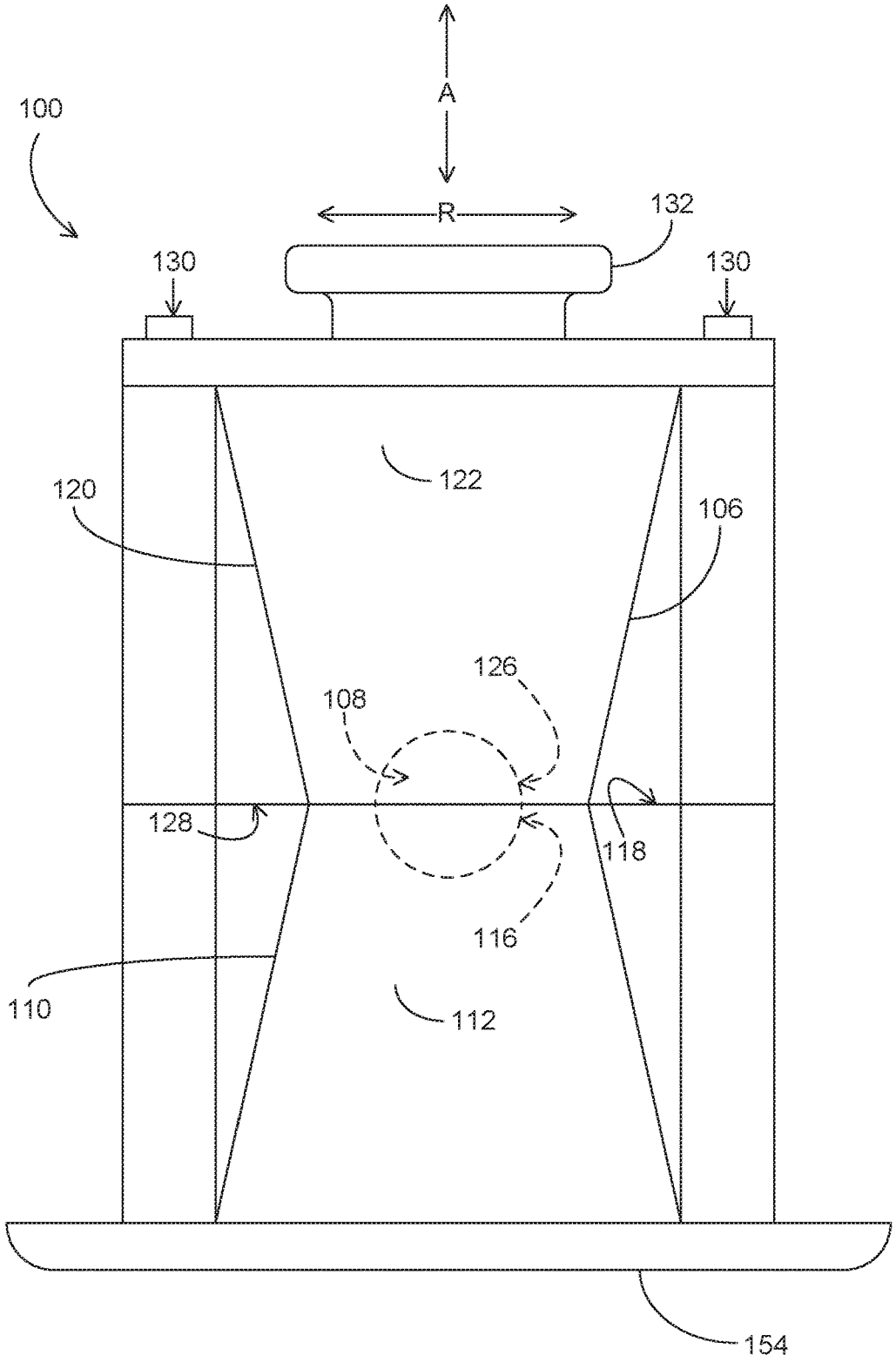
FIG. 2 provides a front plan view of the exemplary ice press appliance of FIG. 1.
Figure 4:
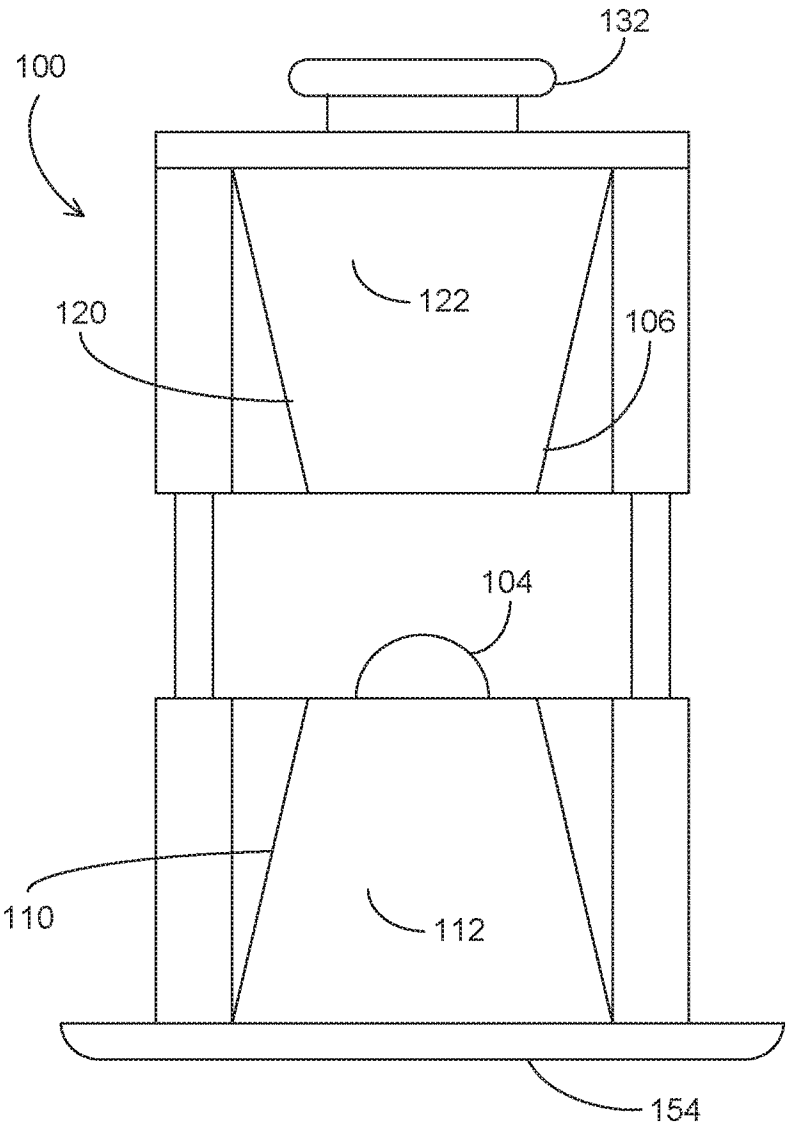
FIG. 4 provides a front plan view of the exemplary ice press appliance of FIG. 2, wherein the ice press appliance is provided in a receiving position with a sculpted ice nugget.
Figure 3:
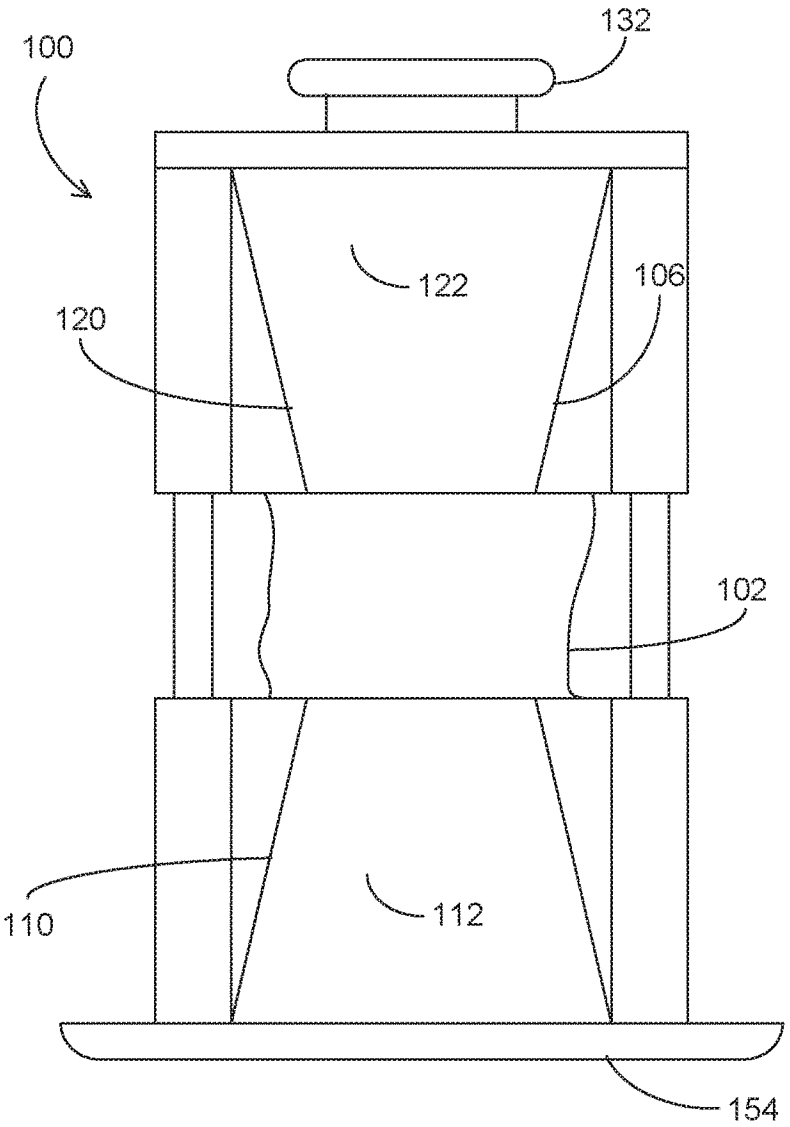
FIG. 3 provides a front plan view of the exemplary ice press appliance of FIG. 2, wherein the ice press appliance is provided in a receiving position with an initial ice billet.
Figure 5:
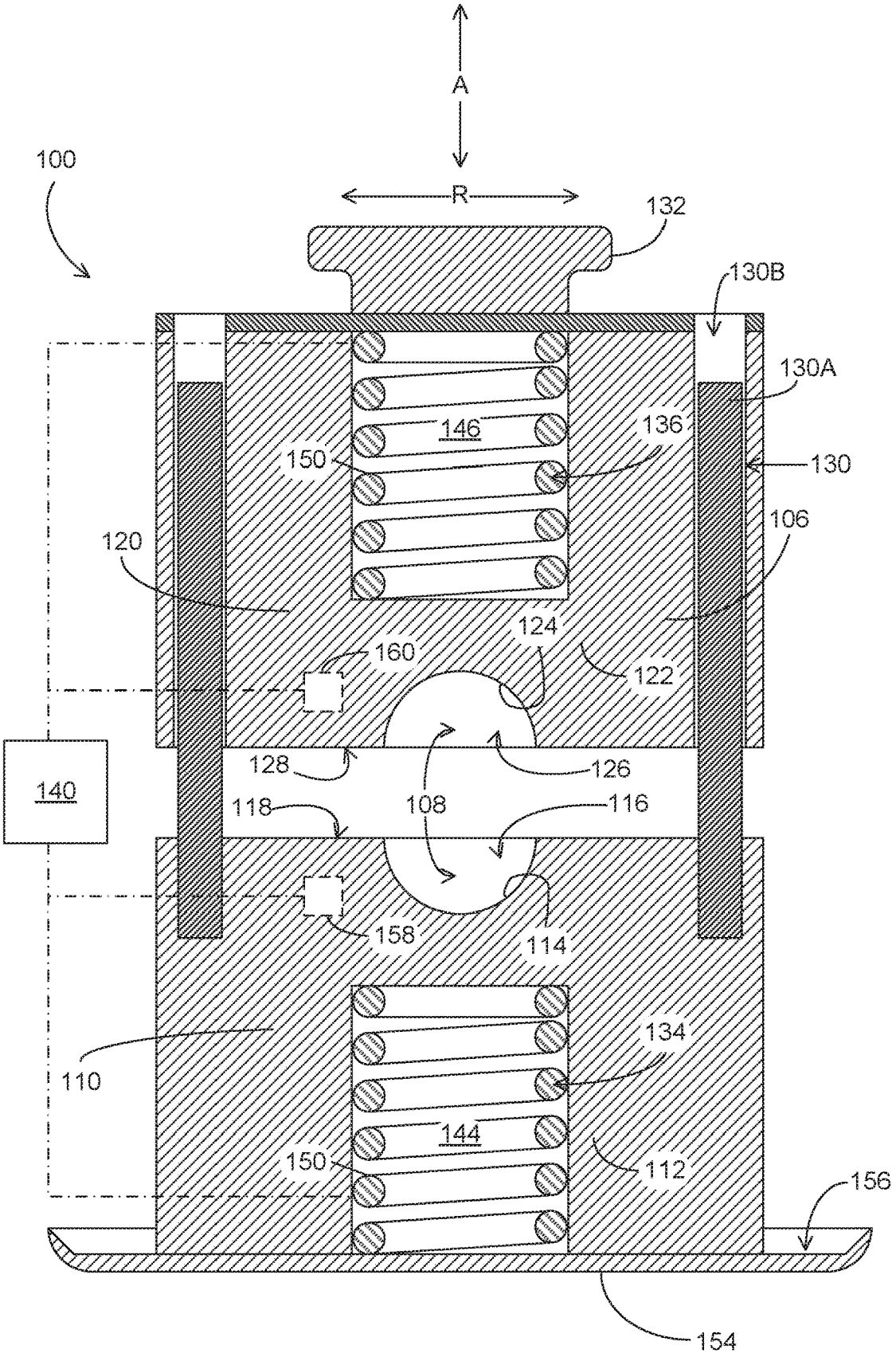
FIG. 5 provides a front cross-sectional view of an ice press appliance according to exemplary embodiments of the present disclosure.
Figure 6:
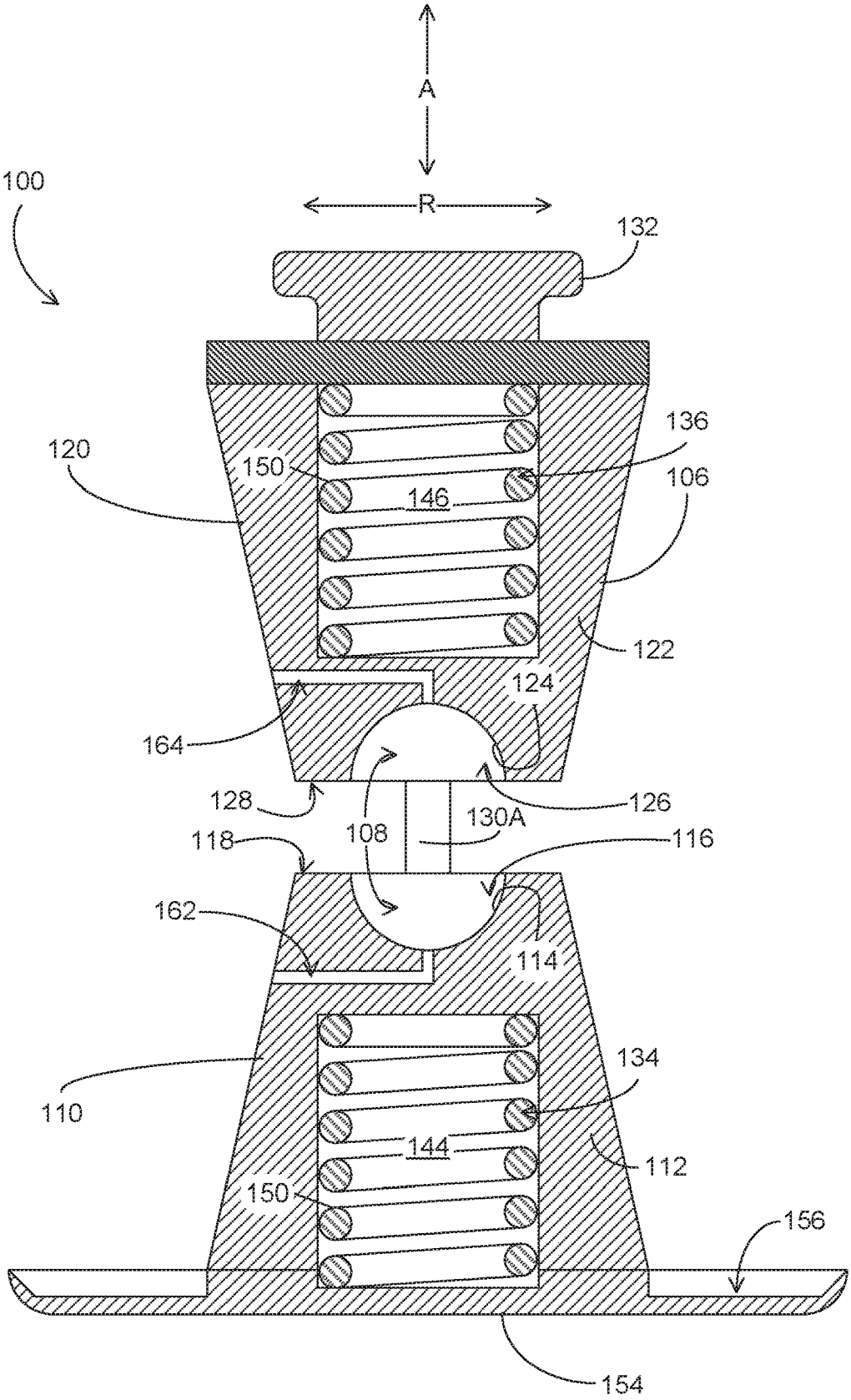
FIG. 6 provides a side cross-sectional view of the exemplary ice press appliance of FIG. 5.

Turning now to the figures, FIGS. 1 through 6 provide views of an ice press 100 according to exemplary embodiments of the present disclosure. Generally, ice press 100 may serve to reshape or transform a relatively-large initial ice billet 102 (e.g., an integral or monolithic block of raw unsculpted ice) into a relatively-small sculpted ice nugget 104 that has a predetermined desirable profile. FIG. 1 provides a perspective view of ice press 100. FIG. 2 provides a plan view of ice press 100 in a closed or sculpted position. FIGS. 3 and 4 provide plan views of ice press 100 in an open or receiving position. FIG. 5 provides a front cross-sectional view of ice press 100. FIG. 6 provides a side cross-sectional view of ice press 100.

As shown, ice press 100 includes a mold body 106 that defines an axial direction A. A radial direction R may be defined outward from (e.g., perpendicular to) axial direction A. A circumferential direction C may be defined about axial direction A (e.g., perpendicular to axial direction A in a plane defined by radial direction R).

Within mold body 106, a mold cavity 108 is defined. As will be described below, within mold cavity 108 the sculpted ice nugget 104 is shaped and its profile is determined. In some embodiments, mold cavity 108 defined by two discrete mold segments 110, 120. For instance, a first mold segment 110 and a second mold segment 120 may be selectively mated to each other and, together, define mold cavity 108.

Each mold segment 110, 120 generally includes an outer sidewall 112, 122 and an inner cavity wall 114, 124. In particular, the outer sidewall 112, 122 of each mold segment 110, 120 faces outward (e.g., in the radial direction R) toward the ambient environment. The outer sidewall 112, 122 may generally extend about the axial direction A (e.g., along the circumferential direction C). Moreover, the outer sidewall outer sidewall 112, 122 may extend from an upper portion of the corresponding mold segment 110, 120 to a lower portion of the mold segment 110, 120. As a result, a user may be able to view and touch the outer sidewall 112, 122 of each assembled mold segment 110, 120, regardless of whether ice press 100 is in the receiving position or the sculpted position.

In contrast to the outer sidewall 112, 122, the inner cavity wall 114, 124 of each mold segment 110, 120 faces inward (e.g., within mold body 106) and toward mold cavity 108. For instance, each inner cavity wall 114, 124 may be formed about and extend radially outward from the axial direction A. The inner cavity wall 114 of the first mold segment 110 may generally face upward (e.g., relative to the axial direction A) toward a bottom portion of the second mold segment 120. The inner cavity wall 124 of the second mold segment 120 may generally face downward (e.g., relative to the axial direction A) toward an upper portion of first mold segment 110.

In some embodiments, the inner cavity walls 114, 124 define at least a portion of mold cavity 108. For instance, the inner cavity wall 114 of first mold segment 110 may form a first cavity portion 116 (e.g., along the inner cavity wall 114). Additionally or alternatively, the inner cavity wall 124 of second mold segment 120 may define a second cavity portion 126 (e.g., above the first cavity portion 116 along the corresponding inner cavity wall 124 o second mold segment 120). As shown, each inner cavity wall 114, 124 may be generally open to the ambient environment when ice press 100 is in the receiving position and enclosed or otherwise restricted from user view and access when ice press 100 is in the sculpted position.

An equatorial rim 118, 128 generally joins a corresponding outer sidewall 112, 122 and inner cavity wall 114, 124. In particular, equatorial rim 118, 128 may extend along the radial direction R between the outer sidewall 112, 122 and the inner cavity wall 114, 124. For instance, an equatorial rim 118 of first mold segment 110 may extend in the radial direction R from the perimeter or outer radial extreme of inner cavity wall 114 to the corresponding outer sidewall 112. An equatorial rim 128 of second mold segment 120 may extend in the radial direction R from the perimeter or outer radial extreme of inner cavity wall 124 to the corresponding outer sidewall 122. Together, the equatorial rims 118, 128 may be formed as complementary surfaces to contact each other (e.g., in the sculpted position).

It is generally understood that mold body 106 may be formed from any suitable material. For instance, one or more portions (e.g., inner cavity walls 114, 124) may be formed from a conductive metal, such as aluminum, stainless, steel, or copper (including alloys thereof). Optionally, one or more portions of mold body 106 may be integrally formed (e.g., as unitary monolithic members). As an example, inner cavity wall 114 of first mold segment 110 may be integrally formed within one or both of equatorial rim 118 and outer sidewall 112. As an additional or alternative example, inner cavity wall 124 of second mold segment 120 may be integrally formed with one or both of equatorial rim 128 and outer sidewall 122.

Generally, the sculpted ice nugget 104 will be shaped within and conform to mold cavity 108 along the inner cavity walls 114, 124. The resulting sculpted ice nugget 104 is therefore a solid unitary ice piece that is shaped according to the shape or profile of inner cavity walls 114, 124 (e.g., in the sculpted position). Thus, the adjoined inner cavity walls 114, 124 (i.e., in the sculpted position) and cavity portions 116, 126 may define the ultimate shape or profile of sculpted ice nugget 104.

In some embodiments, one or both of cavity portions 116, 126 are hemispherical voids. For instance, first cavity portion 116 may be a lower hemispherical void and second cavity portion 126 may be an upper hemispherical portion. Together, the cavity portions 116, 126 may thus define mold cavity 108 and thereby sculpted ice nugget 104 as a sphere. Optionally, each hemispherical void may have a diameter that is greater than two inches. Nonetheless, it is understood that any other suitable shape (e.g., a geometric cube, polyhedron, etc.) or profile may be provided. Moreover, it is further understood that additional or alternative embodiments may provide a predefined embossing or engraving along one or more of the inner cavity walls 114, 124 to direct the shape or profile of sculpted ice nugget 104.

As illustrated, the mold segments 110, 120 can be selectively separated or moved relative to each other (e.g., as desired by user). For instance, second mold segment 120 may be movably positioned above first mold segment 110 along the axial direction A. When assembled, second mold segment 120 may thus move (e.g., slide or pivot) up and down along the axial direction A. In particular, second mold segment 120 may move and alternate between the sculpted position (e.g., FIG. 2) and the receiving position (e.g., FIGS. 3 and 4).

In the sculpted position, mold cavity 108 is generally enclosed. Access to mold cavity 108 is thus restricted. Moreover, second mold segment 120 may be supported or rest on first mold segment 110. In some such embodiments, a lower portion of second mold segment 120 contacts (e.g., directly or indirectly contacts) an upper portion of first mold segment 110. For instance, the first equatorial rim 118 may directly contact the second equatorial rim 128. In the sculpted position, both cavity portions 116, 126 may be aligned (e.g., in the axial direction A and the radial direction R) in mutual fluid communication. The unified mold cavity 108 may furthermore be enclosed by the cavity portions 116, 126 (e.g., at the inner cavity walls 114, 124 defining first cavity portion 116 and second cavity portion 126, respectively).

In contrast to the sculpted position, mold cavity 108 is generally open in the receiving position. For instance, discrete portions 116, 126 of mold cavity 108 may be separated from each other such that a void or gap is defined (e.g., in the axial direction A) between first mold segment 110 and second mold segment 120. Access to mold cavity 108 may thus be permitted. Moreover, as illustrated in FIG. 3, the initial ice billet 102 (being larger in volume than the volume of the enclosed mold cavity 108) may be placed on mold body 106. Specifically, the initial ice billet 102 may be placed on an upper portion of first mold segment 110 or within the void or gap defined between first mold segment 110 and second mold segment 120. If a reshaping operation has already been performed (e.g., the initial ice billet 102 has been reshaped as the sculpted ice nugget 104), the sculpted ice nugget 104 may be accessed at the receiving position, as illustrated in FIG. 4.

In certain embodiments, the movement of second mold segment 120 relative to first mold segment 110 is guided by one or more attachment features. For instance, as shown in the exemplary embodiments of FIGS. 1 through 8, one or more complementary guide rail-sleeve pairs 130 may be defined between first mold segment 110 and second mold segment 120 on mold body 106. Such guide rail-sleeve pairs 130 each include a mated guide rail 130A and sleeve 130B within which the guide rail 130A may slide. Each guide rail-sleeve pair 130 may extend parallel to the axial direction A to guide or facilitate the sliding of second mold segment 120 relative to first mold segment 110 along the axial direction A. Moreover, guide rail-sleeve pairs 130 may align the mold segments 110, 120 (e.g., as second mold segment 120 moves to the sculpted position). Optionally, the guide rail-sleeve pairs 130 may be freely separable (e.g., upward along the axial direction A), thereby permitting the complete removal of second mold segment 120 from first mold segment 110. Notably, a wider variety of sizes of ice billet 102 may be accommodated between the mold segments 110, 120.

As shown, a handle 132 may be fixed to second mold segment 120 (e.g., at a top portion thereof), allowing a user to easily grab or lift second mold segment 120. In some such embodiments, the lifting force necessary to move second mold segment 120 upward (e.g., from the sculpted position to the receiving position) can be selectively provided, at least in part, by a user. A closing force necessary to move second mold segment 120 downward (e.g., from the receiving position to the sculpted position) may be provided, at least in part, by gravity.

Although the figures illustrate two manual sliding guide rail-sleeve pairs 130. It is understood that any other suitable alternative arrangement may be provided for connecting and guiding movement between first mold segment 110 and second mold segment 120. As an example, three or more sliding guide rail-sleeve pairs 130 may be provided. As an additional or alternative example, one or more motors (e.g., linear actuators) may be provided to motivate or assist relative movement of the mold segments 110, 120. As yet another additional or alternative example, a multi-axis pivot assembly (e.g., having at least two parallel rotation axes) may connect second mold segment 120 to first mold segment 110 and permit rotational as well as axial movement.

Figure 7:
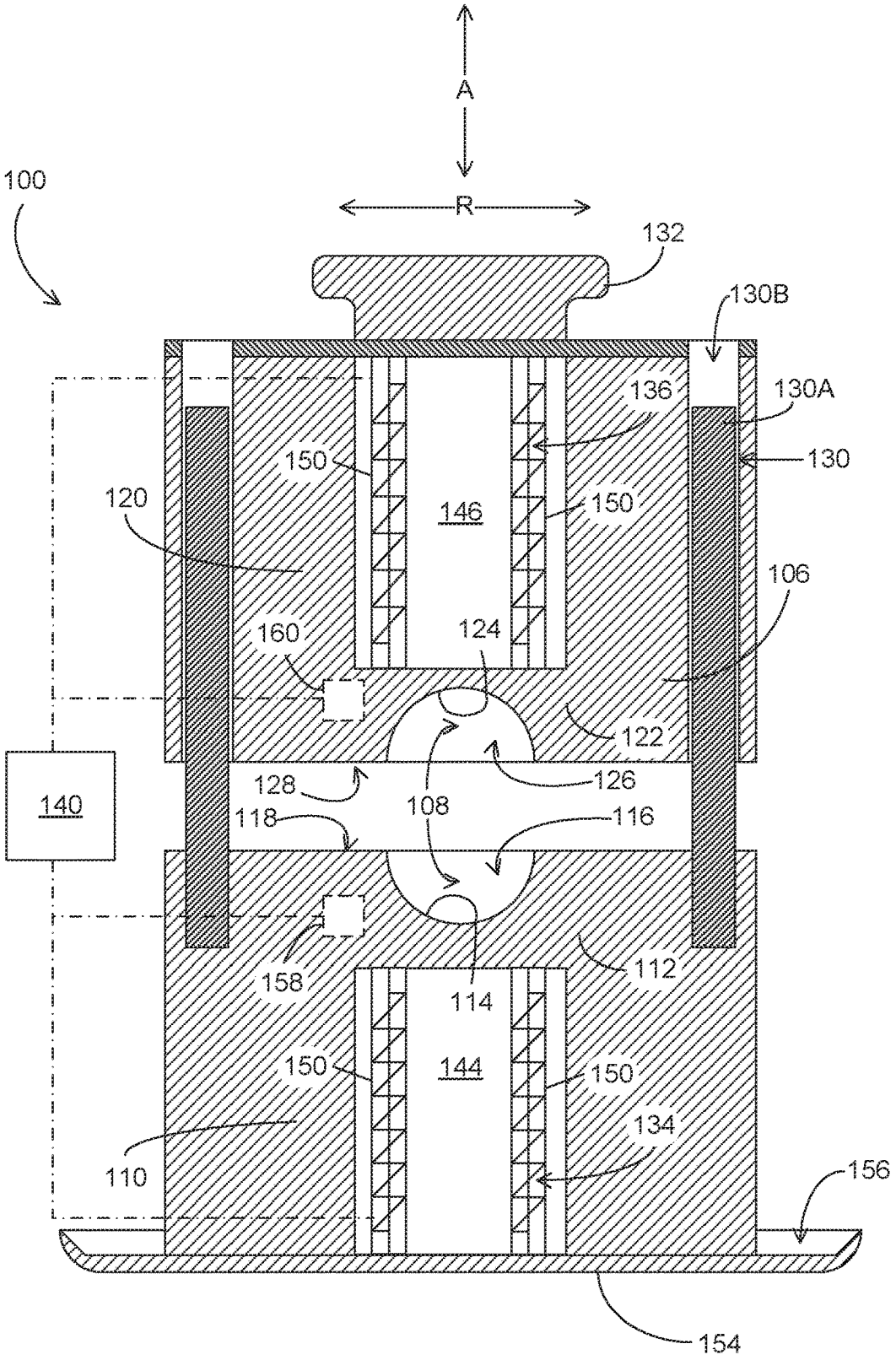
FIG. 7 provides a front cross-sectional view of an ice press appliance according to exemplary embodiments of the present disclosure.
Figure 8:
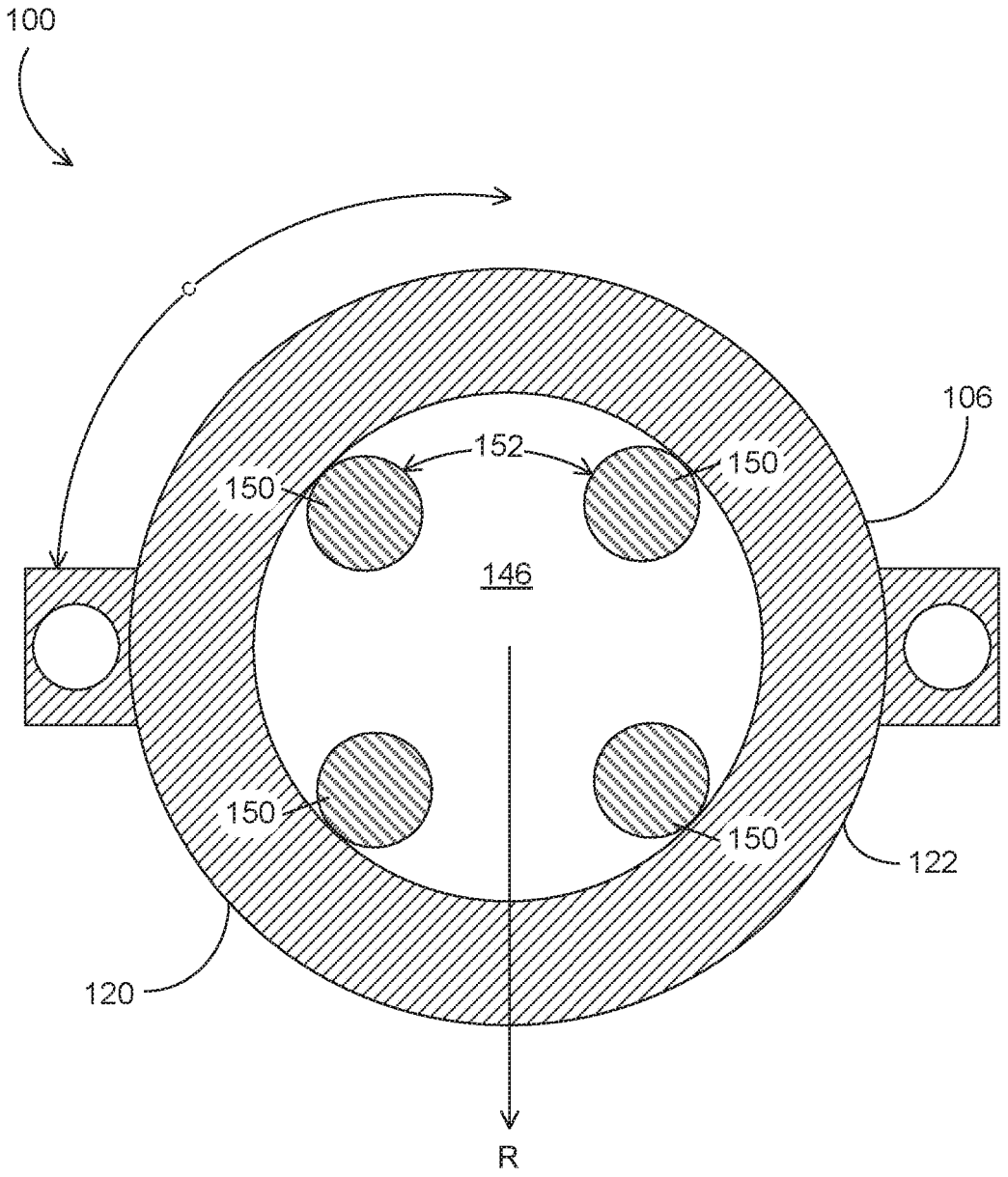
FIG. 8 provides a top cross-sectional view of the exemplary ice press appliance of FIG. 7.

Turning generally to FIGS. 5 through 8, ice press 100 includes one or more electric heaters 134, 136 that is/are disposed within mold body 106 to generate heat during use (e.g., reshaping operations). FIGS. 5 and 6 respectively provide front and side cross-sectional views of one exemplary embodiment, including one configuration of heaters 134, 136. FIGS. 7 and 8 respectively provide front and top cross-sectional views of another exemplary embodiment, including a unique configuration of heaters 134, 136. It is noted that although these exemplary embodiments are explicitly illustrated, one of ordinary skill in the art would understand that additional or alternative embodiments or configuration may be provided to include one or more features of these examples (e.g., to include one or more additional heaters or configurations from those shown in FIGS. 5 through 8).

Generally, operation of the heater(s) 134, 136 may be directed by a controller 140 in operative communication (e.g., wireless or electrical communication) therewith. Controller 140 may include a memory (e.g., non-transitive media) and microprocessor, such as a general or special purpose microprocessor operable to execute programming instructions or micro-control code associated with a selected heating level, operation, or cooking cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 140 may be constructed without using a microprocessor (e.g., using a combination of discrete analog or digital logic circuitry, such as switches, amplifiers, integrators, comparators, flip-flops, AND gates, and the like) to perform control functionality instead of relying upon software.

As shown, the electric heater(s) 134, 136 is/are disposed within mold body 106 in conductive thermal engagement with mold cavity 108. Heat generated at the electric heater(s) 134, 136 may thus be conducted through mold body 106 and to mold cavity 108 (e.g., through inner cavity walls 114, 124).

In some embodiments, multiple electric heaters 134, 136 are provided as a discrete base heater 134 and top heater 136. As shown, base heater 134 is mounted within first mold segment 110. For instance, base heater 134 may be disposed within a base heat chamber 144. Base heat chamber 144 may be defined within first mold segment 110 radially inward from the outer sidewall 112. Base heat chamber 144 may further be axially spaced apart from the first cavity portion 116 (e.g., below mold cavity 108 such that inner cavity wall 114 is positioned between first cavity portion 116 and base heat chamber 144).

In contrast to base heater 134, top heater 136 is mounted within second mold segment 120. For instance, top heater 136 may be disposed within a top heat chamber 146. Top heat chamber 146 may be defined within second mold segment 120 radially inward from the outer sidewall 122. Top heat chamber 146 may further be axially spaced apart from the second cavity portion 126 (e.g., above mold cavity 108 such that inner cavity wall 124 is positioned between second cavity portion 126 and top heat chamber 146).

Generally, the electric heater(s) 134, 136 are provided as any suitable electrically-driven heat generator. For instance, base heater 134 or top heater 136 may include one or more resistive heating elements (e.g., heating elements 150). Additionally or alternatively, it is understood that other suitable heating elements, such as a thermoelectric heating element, may be included with the electric heater(s) 134, 136.

In some embodiments, each electric heater 134, 136 includes one or more heating elements 150 that are evenly distributed about the axial direction A. As an example, and as shown in the exemplary embodiments of FIGS. 5 and 6, base heater 134 or top heater 136 may include an electric heating element 150 coiled such that a plurality of turns extending along the circumferential direction C about the axial direction A (e.g., radially spaced from the axial direction A).

As another example, and as shown in the exemplary embodiments of FIGS. 7 and 8, base heater 134 or top heater 136 may include a plurality of circumferentially-spaced electric heater 134, 136 elements disposed within the mold body 106 (e.g., as a plurality of discrete linear heating elements). Thus, a predetermined number of electric heating elements 150 may be separated by a predetermined circumferential distance. Such electric heating element 150 may be positioned parallel to the axial direction A or, alternatively, at a non-parallel angle relative to the axial direction A. Optionally, the circumferential distance 152 between each adjacent pair of heating elements 150 may be equal. Moreover, although four electric heating elements 150 are shown, it is noted that any suitable number of circumferentially-spaced heating elements 150 may be provided (e.g., two, three, more than four, etc.).

Embodiments including both base heater 134 and top heater 136 may be configured to operate both heaters 134, 136 simultaneously. For instance, controller 140 and a corresponding power source (not pictured) may be in operative communication (e.g., wired electrical communication) heaters 134, 136 to selectively direct both base heater 134 and top heater 136 to activate (e.g., generate heat) in tandem.

In certain embodiments, one or more temperature sensors 158, 160 (e.g., thermistors, thermocouples, dielectric switches, etc.) are provided on or within mold body 106 (e.g., in thermal communication with mold cavity 108). Moreover, such temperature sensors 158, 160 may be in operative communication (e.g., wired electrical communication) with controller 140. In some embodiments, a base temperature sensor 158 is mounted within first mold segment 110. In additional or alternative embodiments, a top temperature sensor 160 is mounted within second mold segment 120.

In certain embodiments, the controller 140 is configured to activate, deactivate, or adjust the heaters 134, 136 based on temperature detected at the sensor(s) 158, 160. As an example, a predetermined temperature threshold value or range may be provided (e.g., at controller 140) to prevent overheating of the heaters 134, 136. If a detected temperature at sensor 158 or 160 is determined to exceed the threshold value or range, heater 134 or 136 may be deactivated or otherwise restricted in heat output. If a subsequent detected temperature at sensor 158 or 160 is determined to fall below or within the threshold value or range, heater 134 or 136 may be reactivated or otherwise increased in heat output. Optionally, deactivation-reactivation may be repeated continuously (e.g., as a closed feedback loop) during operation of ice press 100. Notably, excessive temperatures at the mold body 106 may be prevented (e.g., when mold body 106 is not in contact with ice or when a reshaping operation for a sculpted nugget 104 is complete). Moreover, although one example of heat control and adjustment using a threshold value or range is explicitly described, it is noted any suitable configuration may further be provided (e.g., within controller 140).

Advantageously, the described embodiments of ice press 100 may rapidly and evenly heat ice billet 102 (FIG. 3) from opposite axial ends as mold body 106 is guided to the sculpted position. Moreover, the press 100 may advantageously be reused multiple times without requiring any interruption to use (e.g., other than removing a sculpted ice nugget 104 from first cavity portion 116 and placing a new ice billet 102 between the mold segments 110, 120). Furthermore, relatively little of material may be required for such rapid and repeated ice shaping.

Turning now especially to FIG. 6, in some embodiments, one or more portions of mold body 106 are tapered (e.g., radially inward). Such tapering may generally extend inward toward the mold cavity 108. As an example, the outer sidewall 112 of first mold segment 110 may be tapered from a lower portion of the first mold segment 110 to an upper portion of the first mold segment 110 (e.g., along the axial direction A from a receiving tray 154 to the first equatorial rim 118). In some such embodiments, at least a portion of outer sidewall 112 thus forms a frusto-conical member having a larger diameter at the lower portion (e.g., distal to mold cavity 108) and a smaller diameter at the upper portion (e.g., proximal to mold cavity 108).

As an additional or alternative example, the outer sidewall 122 of second mold segment 120 may be tapered from an upper portion of the second mold segment 120 to a lower portion of the second mold segment 120 (e.g., along the axial direction A from the handle 132 to the second equatorial rim 128). In some such embodiments, at least a portion of outer sidewall 122 thus forms a frusto-conical member having a larger diameter at the upper portion (e.g., distal to mold cavity 108) and a smaller diameter at the lower portion (e.g., proximal to mold cavity 108).

In some embodiments, both outer sidewalls 112, 122 are formed as mirrored tapered bodies that converge, for instance, radially outward from mold body 106. Notably, extraneous portions of the initial ice billet 102 (FIG. 3) that are not needed for the mass of the sculpted ice nugget 104 (FIG. 4) may be readily separated from billet 102 (e.g., as shaved ice chunks) and directed away from mold cavity 108. Moreover, the tapered form may advantageously concentrate the heat directed towards the ice billet 102 (e.g., radially outward from the cavity portions 116, 126).

In optional embodiments, a receiving tray 154 is provided on first mold segment 110 (e.g., below mold cavity 108). For example, receiving tray 154 may be attached to or formed integrally with first mold segment 110 at a lower portion thereof. As shown, receiving tray 154 extends radially outward from, for instance, outer sidewall 112. Moreover, receiving tray 154 may form a circumferential channel 156 about mold body 106. During use, extraneous portions of the initial ice billet 102 (FIG. 3) may thus accumulate within the circumferential channel 156 of receiving tray 154 (e.g., as water or separated ice chunks), instead of the counter or surface on which ice press 100 is supported.

Remaining at FIG. 6, in certain embodiments, one or more water channels 162, 164 are defined through mold body 106. Such water channels 162, 164 may be in fluid communication with mold cavity 108 and generally permit melted water to flow therefrom (e.g., from an outer sidewall 112, 122 to the ambient environment and, subsequently, receiving tray 154). Moreover, in comparison to the diameter of mold body 106, the diameter of water channels 162, 164 through which water passes may be relatively small (e.g., about $1/16^{th}$ of an inch).

In some embodiments, a first mold segment 110 defines a lower water channel 162 that extends in fluid communication between inner cavity wall 114 and outer sidewall 112. For instance, the lower water channel 162 may extend from the first cavity portion 116 (e.g., at an axially lowermost portion thereof) and to the outer sidewall 112. As ice within the first cavity portion 116 melts to liquid water, at least a portion of that water may thus pass from the first cavity portion 116, through the lower water channel 162, and to the ambient environment (e.g., toward the receiving tray 154). Notably, melted water may be readily exhausted from below mold cavity 108, permitting contact to be maintained between inner cavity wall 114 and the ice thereabove as it is melted.

In additional or alternative embodiments, a second mold segment 120 defines an upper water channel 164 that extends in fluid communication between inner cavity wall 124 and outer sidewall 122. For instance, the upper water channel 164 may extend from the second cavity portion 126 (e.g., at an axially uppermost portion thereof) and to the outer sidewall 122. As ice within the second cavity portion 126 melts to liquid water, at least a portion of that water may thus pass from the second cavity portion 126, through the upper water channel 164, and to the ambient environment (e.g., toward the receiving tray 154). Notably, melted water may be readily exhausted from above mold cavity 108, permitting contact to be maintained between inner cavity wall 124 and the ice therebelow as it is melted.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. Active ice press to reshape an initial ice billet as a sculpted ice nugget, the active ice press comprising:

a mold body defining an axial direction and a mold cavity within which the sculpted ice nugget is shaped, the mold body comprising a first mold segment defining a first cavity portion of the mold cavity, and a second mold segment movably positioned above the first mold segment along the axial direction, the second mold segment defining a second cavity portion of the mold cavity; and an electric heater disposed within the mold body in conductive thermal engagement with the mold cavity, wherein the first mold segment comprises an outer sidewall facing an ambient environment, and an inner cavity wall facing the mold cavity, wherein the second mold segment comprises an outer sidewall facing an ambient environment and an inner cavity wall facing the mold cavity, and wherein the outer sidewall of the first mold segment and the outer sidewall of the second mold segment are each tapered radially inward along the axial direction toward the mold cavity.

2. The active ice press of claim 1, wherein the electric heater is a base heater mounted within the first mold segment, and wherein the active ice press further comprises a top heater mounted within the second mold segment.

3. The active ice press of claim 1, wherein the electric heater comprises a plurality of circumferentially-spaced electric heating elements disposed within the mold body.

4. The active ice press of claim 1, wherein the electric heater comprises a resistive heating element.

5. The active ice press of claim 1, wherein the first mold segment further defines a water channel extending in fluid communication between the inner cavity wall and the outer sidewall to direct water from the first cavity portion to the ambient environment.

6. The active ice press of claim 1, wherein the second cavity portion is defined along the inner cavity wall of the second mold segment, and wherein the second mold segment further defines a water channel extending in fluid communication between the inner cavity wall and the outer sidewall to direct water from the second cavity portion to the ambient environment.

7. The active ice press of claim 1, wherein a receiving tray extends radially outward from first mold segment to receive extraneous portions of the initial ice billet.

8. The active ice press of claim 1, wherein the first cavity portion is an upper hemispherical void, and wherein the second cavity portion is a lower hemispherical void.

9. The active ice press of claim 1, wherein the second mold segment is movable between a receiving position and a sculpted position, wherein the second mold segment is spaced apart from the first mold segment along the axial direction at the receiving position, and wherein the second mold segment is supported on the first mold segment at the sculpted position.

10. The active ice press of claim 9, wherein the first cavity portion and the second cavity portion enclose the mold cavity in mutual fluid communication at the sculpted position.

11. Active ice press to reshape an initial ice billet as a sculpted ice nugget, the active ice press comprising:

a mold body defining an axial direction and a mold cavity within which the sculpted ice nugget is shaped, the mold body comprising a first mold segment at least partially defining the mold cavity, and a second mold segment movably positioned above the first mold segment between a receiving position spaced apart from the first mold segment along the axial direction and a sculpted position supported on the first mold segment, the second mold segment at least partially defining the mold cavity in the sculpted position;

a base heater mounted within the first mold segment in conductive thermal engagement with the mold cavity; and a top heater mounted within the second mold segment in conductive thermal engagement with the mold cavity, wherein the first mold segment comprises an outer sidewall facing an ambient environment, and an inner cavity wall facing the mold cavity, wherein the second mold segment comprises an outer sidewall facing an ambient environment and an inner cavity wall facing the mold cavity, and wherein the outer sidewall of the first mold segment and the outer sidewall of the second mold segment are each tapered radially inward along the axial direction toward the mold cavity.

12. The active ice press of claim 11, wherein the base heater comprises a plurality of circumferentially-spaced electric heating elements disposed within the first mold segment, or wherein the top heater comprises a plurality of circumferentially-spaced electric heating elements disposed within the second mold segment.

13. The active ice press of claim 11, wherein the base heater comprises a resistive heating element, and wherein the top heater comprises a resistive heating element.

14. The active ice press of claim 11, wherein a first cavity portion of the mold cavity is defined along the inner cavity wall of the first mold segment, and wherein the first mold segment further defines a water channel extending in fluid communication between the inner cavity wall and the outer sidewall to direct water from the first cavity portion to the ambient environment.

15. The active ice press of claim 11, wherein the second mold segment further defines a water channel extending in fluid communication between the inner cavity wall and the outer sidewall to direct water from the second cavity portion to the ambient environment.

16. The active ice press of claim 11, wherein a receiving tray extends radially outward from first mold segment to receive extraneous portions of the initial ice billet.

17. The active ice press of claim 11, wherein first mold segment defines a first cavity portion of the mold cavity as an upper hemispherical void, and wherein the second mold segment defines a second cavity portion of the mold cavity as a lower hemispherical void.

18. The active ice press of claim 11, wherein first mold segment defines a first cavity portion of the mold cavity, wherein the second mold segment defines a second cavity portion of the mold cavity, and wherein the first cavity portion and the second cavity portion enclose the mold cavity in mutual fluid communication at the sculpted position.

* * * * *